US010150609B2

(12) United States Patent
Giraud et al.

(10) Patent No.: US 10,150,609 B2
(45) Date of Patent: Dec. 11, 2018

(54) DISPENSER

(71) Applicant: CSP Technologies, Inc., Auburn, AL (US)

(72) Inventors: Jean-Pierre Giraud, Auburn, AL (US); Herve Pichot, Chennevieres-sur-Marne (FR)

(73) Assignee: CSP TECHNOLOGIES, INC., Auburn, AL (US)

( * ) Notice: Subject to any disclaimer, the term of this patent is extended or adjusted under 35 U.S.C. 154(b) by 320 days.

(21) Appl. No.: 14/648,405

(22) PCT Filed: Dec. 3, 2013

(86) PCT No.: PCT/US2013/072745
§ 371 (c)(1),
(2) Date: May 29, 2015

(87) PCT Pub. No.: WO2014/089003
PCT Pub. Date: Jun. 12, 2014

(65) Prior Publication Data

US 2015/0307259 A1 Oct. 29, 2015

Related U.S. Application Data

(60) Provisional application No. 61/733,178, filed on Dec. 4, 2012.

(51) Int. Cl.
*B65D 83/04* (2006.01)
*B65D 50/04* (2006.01)

(52) U.S. Cl.
CPC ..... *B65D 83/0436* (2013.01); *B65D 50/045* (2013.01); *B65D 83/049* (2013.01)

(58) Field of Classification Search
CPC ..... B65D 83/0427; B65D 2251/1058; B65D 25/005; B65D 83/0811; B65D 83/0436; B65D 50/045
See application file for complete search history.

(56) References Cited

U.S. PATENT DOCUMENTS 3,620,413 A * 11/1971 Borsum ..... B65D 83/049 221/256
3,622,041 A * 11/1971 Borsum ..... B65D 83/049 141/321

(Continued)

FOREIGN PATENT DOCUMENTS

EP 1582476 A1 10/2005
GB 2082552 A 3/1982

(Continued)

*Primary Examiner* — Gene O Crawford
*Assistant Examiner* — Kelvin L. Randall, Jr.
(74) *Attorney, Agent, or Firm* — David B. Gornish; Eckert Seamans Cherin & Mellott LLC

(57) ABSTRACT

A dispenser for dispensing product that includes a dispenser body having first and second interior sections, a lid, and a release mechanism. Product in the first interior section passes through an opening in the second interior portion and into an inner channel for dispensing. The inner channel includes a prong that prevent product from reverting back to the first interior section. The lid includes a lip that, when the dispenser is closed, creates a seal about the inner channel. When the dispenser is to be opened, the user may activate the release mechanism, which includes an upper portion and an activation portion. The user inwardly presses the release activation portion, which deflects or bends a portion of the inner channel away from the lip. The user may also downwardly press on the release mechanism to release the upper portion from engagement with the lip and the sidewall.

11 Claims, 25 Drawing Sheets

(56) References Cited

U.S. PATENT DOCUMENTS 4,126,224 A 11/1978 Laauwe et al.
4,260,067 A * 4/1981 Andruchiw ..... B65D 50/06 215/216
4,530,447 A * 7/1985 Greenspan ..... B65D 83/04 221/288
4,940,167 A * 7/1990 Fillmore ..... B65D 47/0838 215/216
5,911,937 A 6/1999 Hekal
6,080,350 A 6/2000 Hekal
6,082,572 A 7/2000 Galton-Fenzi et al.
6,124,006 A 9/2000 Hekal
6,130,263 A 10/2000 Hekal
6,174,952 B1 1/2001 Hekal
6,214,255 B1 4/2001 Hekal
6,221,446 B1 4/2001 Hekal
6,863,175 B2 * 3/2005 Gelardi ..... B65D 50/045 206/1.5
7,000,792 B2 * 2/2006 Arai ..... B65D 43/22 215/237
7,213,720 B2 5/2007 Giraud
7,537,137 B2 5/2009 Giraud
8,308,004 B2 * 11/2012 Keung ..... B65D 47/0804 215/237
8,322,567 B2 * 12/2012 Giraud ..... B29C 33/44 220/4.23
8,528,778 B2 9/2013 Giraud
8,657,155 B2 * 2/2014 Dwork ..... B65D 47/0866 221/229
2004/0007595 A1 * 1/2004 Stull ..... B65D 50/045 222/153.14
2004/0159661 A1 * 8/2004 Aochi ..... B65D 25/2811 220/264
2006/0096984 A1 * 5/2006 Bandoh ..... B65D 43/164 220/254.5
2007/0205177 A1 * 9/2007 Delage ..... B65D 47/0814 215/305
2007/0228042 A1 10/2007 Yeager
2014/0299623 A1 * 10/2014 Giraud ..... B65D 83/0864 221/279
2016/0130047 A1 * 5/2016 Koenigseder ..... B65D 47/0804 222/556

FOREIGN PATENT DOCUMENTS

GB 2166423 A 5/1986
GB 2449505 A 11/2008
JP H09 315455 A 12/1997

* cited by examiner

100

DISPENSER

CROSS-REFERENCE TO RELATED APPLICATIONS

This application is a U.S. National Phase of International Application No. PCT/US2013/072745 filed Dec. 3, 2013, which claims priority to U.S. Provisional Patent Application No. 61/733,178 filed Dec. 4, 2012, which are incorporated herein by reference in their entirety.

BACKGROUND OF THE INVENTION

The present invention relates to a dispenser to contain products including pharmaceutical dosage forms, tobacco products, or confectioneries.

Product packaging enhances a product with many additional features such as environmental protection and protection from being damaged. Many products are packaged in multiple unit packages or bulk for consumer convenience and packaging efficiency. Typically the entire product is exposed when the package is opened. If the product needs to be protected from the environment, for example humidity, then a seal is required.

One way to ensure the product is protected is to provide a seal for the entire contents of the package. This type of approach may impose certain dimensional, shape or other design constraints on the package design. In this approach, all of the product may be exposed to the consumer or child who opens the package. Some means would be needed to restrain the product so that it is held in place so that it is easy to access but does not fall out of the package.

Another way is to protect the product in a protective envelope or wrapper. When this wrapper is opened, the entire product is exposed. Again, the entire product is exposed to the environment and it is no longer protected. In addition, the entire remaining product is exposed to children.

Depending on the requirements of the package, the design may become complicated with several contradictory constraints that would need to be managed in order to meet the requirements. This could lead to added expense and an undesirable package for the consumer.

BRIEF SUMMARY OF THE INVENTION

An aspect of the invention is a dispenser for the dispensing of product. The dispenser includes a dispenser body having a sidewall. The sidewall generally defines a first interior section and a second interior section of the dispenser body. The first interior section is configured to house the product. The second interior section is configured for the dispensing of the product. Further, the second interior section includes an inner channel and an opening. The opening is configured to allow product to move from the first interior section into the inner channel. Additionally, the inner channel has at least one prong that is configured to prevent product to be dispensed from the inner channel from reverting back to the first interior section.

The dispenser also includes a lid having a lip. The lip is configured to engage the inner channel when the dispenser is in a closed position. The engagement of the lip with the inner channel forms a seal about an upper portion of the inner channel that prevents ambient air from passing through the seal and into the inner channel. The dispenser assembly also includes a release mechanism that has an activation portion and an upper portion. At least a portion of the activation portion is positioned about an aperture in the sidewall. The upper portion is positioned in the second interior portion between the sidewall and the lip when the lid is in a closed position.

Another aspect of the invention is a dispenser for the dispensing of product that has a dispenser body having a front portion, a back portion, and an interior region. At least a portion of the interior region is configured to house the product. The front portion has an aperture. The dispenser also includes a piston assembly having a front outer portion, a spring, a piston hub, at least one prong, a first space, and a cover. The front outer portion is configured for placement in the aperture of the front portion of the dispenser body. The first space is configured to receive product from the interior region. The spring is configured to bias the dispenser in a closed position in which the cover is positioned about an orifice in the back portion of the dispenser body. The dispenser also includes a cap assembly having a cap, an outer hub, and an inner hub. The cap is positioned about an opening in the piston assembly. The outer hub is positioned within an interior portion of the piston hub.

A further aspect of the invention is a dispenser for the dispensing of product comprising a dispenser body and a dispenser wheel. The dispenser body has a sidewall, a bottom portion, and an opening. The sidewall generally defining an interior region of the dispenser body. Further, the sidewall terminates at the opening. The dispenser wheel is rotatably attached to the dispenser body. The dispenser wheel has an outer wall and sidewalls. The outer wall and sidewalls generally define an inner portion of the dispenser wheel. The outer wall terminates at a gap that is configured to allow at least a portion of a product housed in the interior region to be received in the inner portion of the dispenser wheel. The dispenser wheel is configured to be rotated between an open and a closed position.

Figure 1:
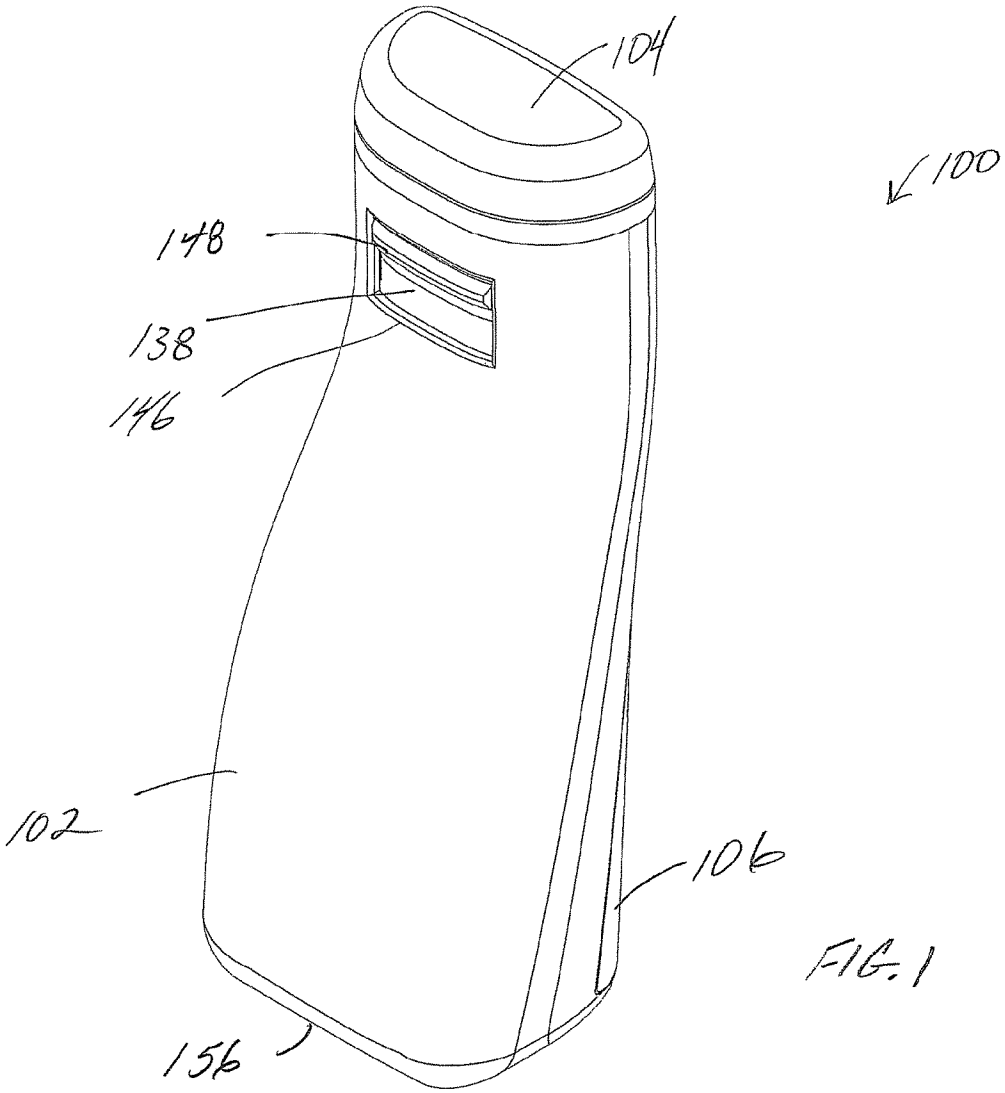
FIG. 1 illustrates a front perspective view of a dispenser with the lid in a closed position according to an embodiment of the present invention.

The following reference characters are used in the specification and figures:

| | |
|---|---|
| 100 | Dispenser |
| 102 | Sidewall |
| 104 | Lid |
| 106 | Cap |
| 108 | Release mechanism |
| 110 | Dispenser body |
| 112 | Hinge |
| 114 | First interior section |
| 116 | Second interior section |
| 118 | Product |
| 120 | Guide |
| 122 | Inlet |
| 124 | Opening |
| 126 | Inner channel |
| 128 | Prong (of inner channel 126) |
| 130 | Gap |
| 132 | Front portion |
| 134 | Back portion |
| 136 | Lip |
| 138 | Activation portion |
| 140 | Spring |
| 142 | Sides |
| 144 | Upper portion |
| 146 | Aperture |
| 148 | Tab |
| 150 | Slots |
| 152 | Backside |
| 154 | Bridge |
| 156 | Base |
| 200 | Dispenser |
| 202 | Dispenser body |
| 204 | Front portion |
| 205 | Sides |
| 206 | Back portion |
| 208 | Top portion |
| 210 | Bottom portion |

-continued

| | |
|---|---|
| 211 | Interior region |
| 212 | Cap assembly |
| 214 | Piston assembly |
| 216 | Front outer portion |
| 218 | Aperture |
| 220 | Spring portion |
| 222 | Piston opening |
| 224 | Piston hub |
| 228 | Prong (of piston assembly 214) |
| 230 | First opening |
| 232 | Second opening |
| 234 | Cover |
| 236 | Orifice |
| 238 | Cap |
| 240 | Outer hub |
| 242 | Inner hub |
| 244 | Guide |
| 246 | Recess |
| 300 | Dispenser |
| 302 | Dispenser body |
| 304 | Dispenser wheel |
| 306 | Sidewall (of dispenser body 302) |
| 308 | Bottom portion |
| 310 | Interior region (of dispenser body 302) |
| 312 | Opening |
| 314 | Outer wall |
| 316 | Sidewall (of dispenser wheel 304) |
| 318 | Inner portion (of dispenser wheel 304) |
| 320 | Gap |
| 322 | Post |
| 324 | Orifice |
| 326 | Tab |

DETAILED DESCRIPTION OF THE INVENTION

The present invention will now be described more fully with reference to the accompanying drawings, in which several embodiments are shown. The invention may, however, be embodied in many different forms and should not be construed as limited to the embodiments set forth here. Rather, these embodiments are examples of the invention, which has the full scope indicated by the language of the claims. Further, certain terminology is used in the foregoing description for convenience and is not intended to be limiting, including, for example, words such as "front," "back," and "bottom," which designate directions in the drawings to which reference is made. This terminology includes the words specifically noted above, derivatives thereof, and words of similar import. Like numbers refer to like elements throughout.

Figure 2:
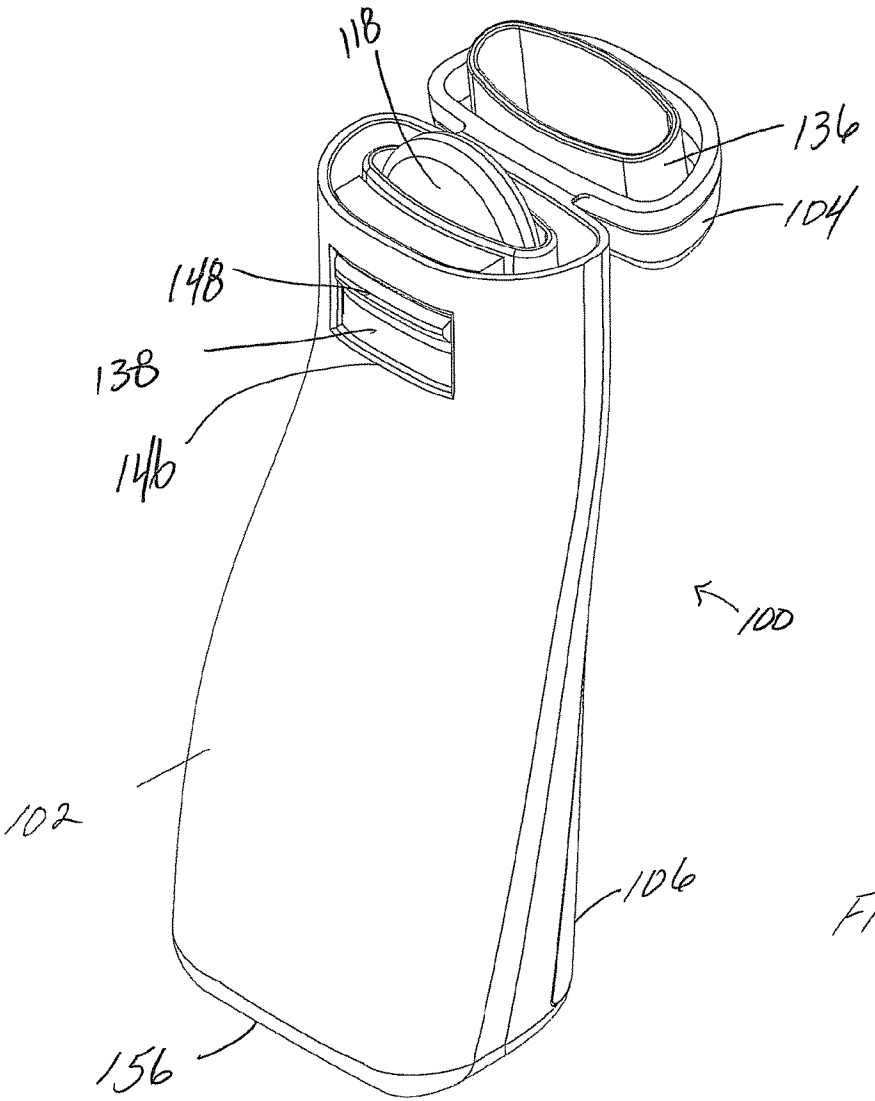
FIG. 2 illustrates a front perspective view of the dispenser shown in FIG. 1 with the lid in an opened position and dispensing a product according to an embodiment of the present invention.
Figure 3:
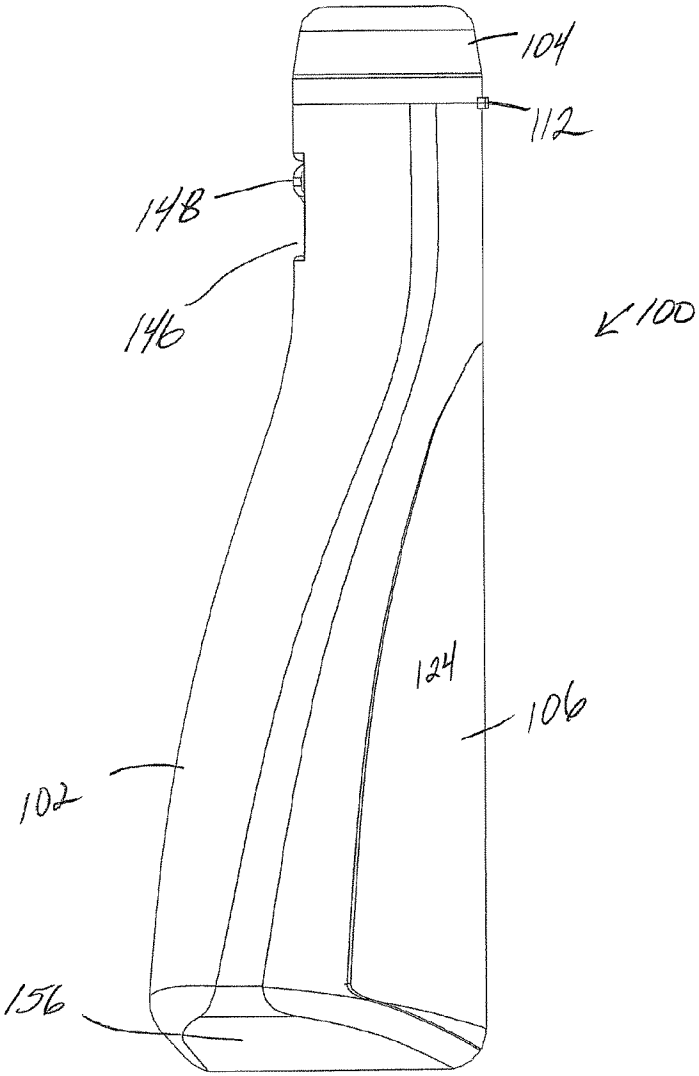
FIG. 3 illustrates a side view of the dispenser shown in FIG. 1.
Figure 4:
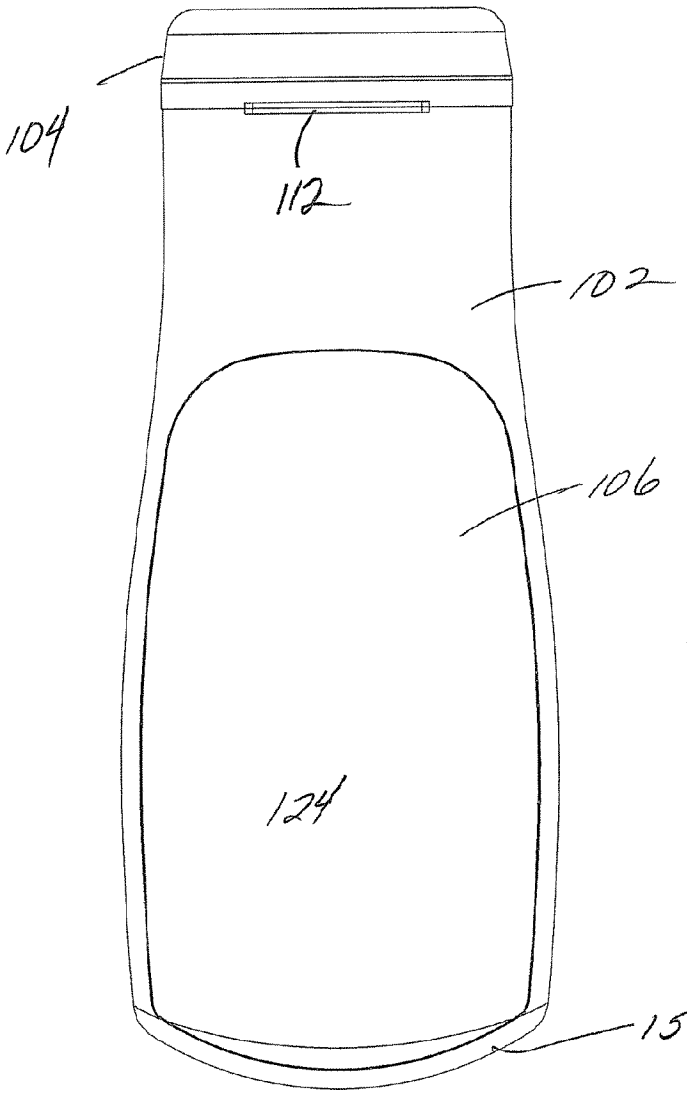
FIG. 4 illustrates a rear view of the dispenser illustrated in FIG. 1.

FIGS. 1-6 illustrate a dispenser 100 according to an embodiment of the present invention. As shown, the dispenser 100 includes a dispenser body 110, a lid 104, a cap 106, and a release mechanism 108. According to certain embodiments, the lid 104 may be attached to the dispenser body 110 by a hinge 112 that allows a user to move the lid 104 from a closed position, as shown in FIG. 1, to an open position, as shown in FIG. 2. According to certain embodiments, the dispenser body 110, lid 104, and hinge 112 may all be integrally molded together. According to other embodiments, the dispenser body 110, hinge 112, and lid 104 may be separate components that are operably connected to each other via the hinge 112. For example, the hinge 112 may be secured to the dispenser body 110 and the lid 104 through the use of a plastic weld, adhesive, or mechanical fastener, such as a screw or rivet, among others. According to other embodiments, the lid 104 and may not be directly or indirectly attached to the dispenser body 110 so that the lid 104 may be removed and separated from the dispenser body 110.

The dispenser body 110 has a sidewall 102 that generally defines a first interior section 114 and a second interior section 116. The first interior section 114 is configured to store or house a product(s) 118, while the second interior section 116 is configured for the dispensing of product 118 that is housed in the dispenser 100. As shown in FIGS. 1-6, according to certain embodiments, at least a portion of the sidewall 102 adjacent to the first interior section 114 may be contoured to outwardly extend from the second interior section 116 so that at least a portion the first interior section 114 is wider than the second interior section 116. Such a contour may be configured to increase the capacity of the first interior section 114 to store product 118, provide a necking effect that funnels product 118 in the first interior section 114 to the dispensing region of the second interior section 116 when the dispenser is in a dispensing position, and/or improve the ergonomic configuration of the dispenser 100. Further, according to certain embodiments, first and/or second interior sections 114, 116 include at least one guide 120, that may assist in properly orienting, rotating, and/or positioning the product 118 so that product 118 may be positioned and/or oriented to enter into the second interior section 116, such as, for example through the opening 124 or into the inner channel 126. According to certain embodiments, the guides 120, which may be fins, may also provide structural support to the dispenser 100, such as, for example, support for at least a portion of the second interior section 116.

The sidewall 102 may include an opening 124 that allows for access to the first interior section 114 of the dispenser 100. Moreover, the opening 124 allows for the insertion of product 118 into the first interior section 114 of the dispenser 100. The opening 124 may be covered by a cap 106 that is configured to assist with retaining product 118 within the first interior section 114 of the dispenser 100. According to certain embodiments, the cap 106 may be removable so as to allow the first interior section 114 to be re-supplied with product 118, if desired. According to such an embodiment, the cap 106 may be operably secured to the dispenser body 110, such as, for example, by a press, interference, or snap fit. Alternatively, according to certain embodiments, the cap 106 may be secured to the dispenser 100 in a manner that prevents or deters removing the cap 106 from the dispenser body 110, such as, for example, through the use of an adhesive or plastic weld, among others.

Figure 5:
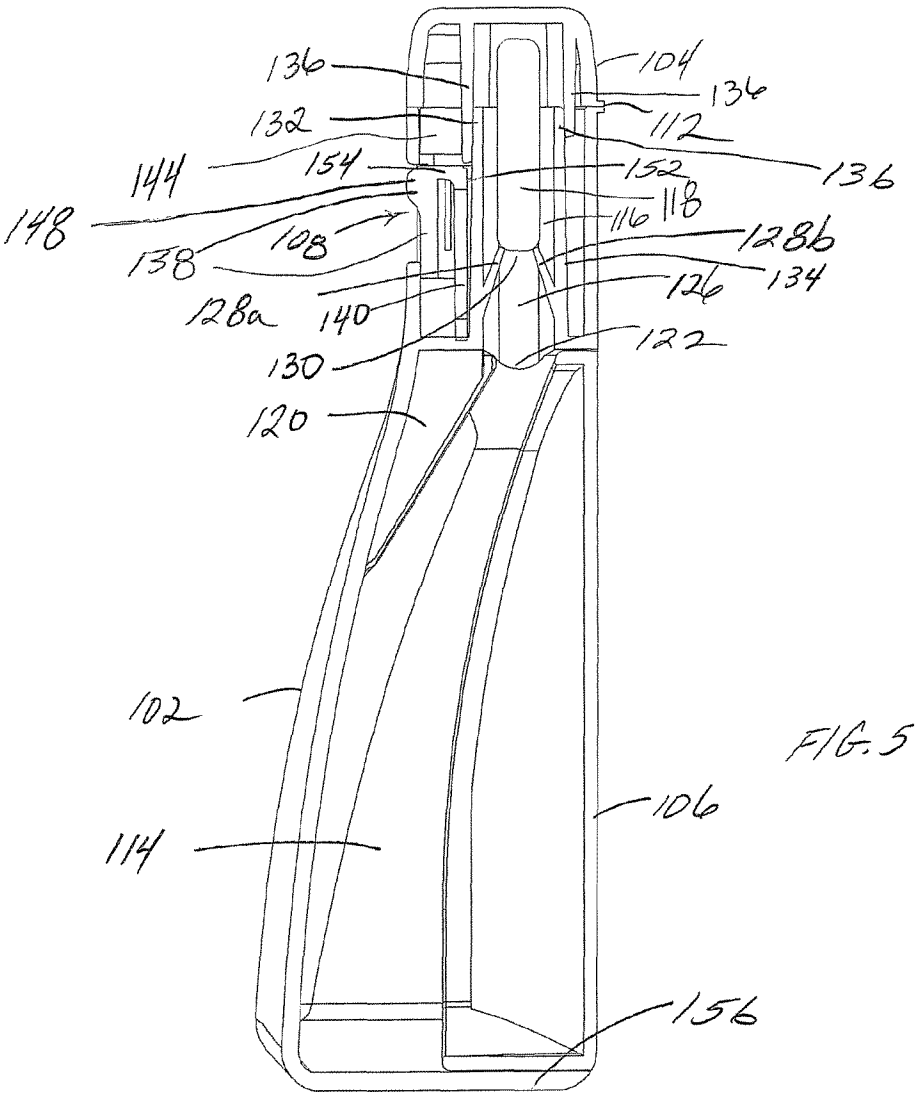
FIG. 5 illustrates a side cross sectional view of the dispenser illustrated in FIG. 1.

As shown in at least FIGS. 2 and 5, the second interior section 116 includes an inner channel 126 that extends from the inlet 122 to the second interior section 116. As shown, according to certain embodiments, the product 118 may need to be in a certain orientation or position to be able to pass into the size constraints of the inlet 122. The inner channel 126 is configured to receive product 118 from the first interior section 114 when the dispenser 100 is dispensing product 118. According to certain embodiments, the inner channel 126 includes at least one prong 128 that is configured to facilitate one-way movement of product 118 through the inner channel 126 so as prevent product 118 positioned for dispensing from reverting back through the inner channel 126 and into the first interior section 114. For example, as shown at least in FIG. 5, according to certain embodiments, the inner channel 126 includes two prong 128*a*, 128*b* positioned on the inside portion of the inner channel 126 that are angled away from the first interior section 114. When product 118 is to be dispensed from the dispenser 100, the dispenser 100 may be positioned, twisted, or shaken so that the product 118 is able to move from the first interior section 114 and pass the prong(s) 128*a*, 128*b* in the inner channel 126 of the second interior section 116. The prong(s) 128*a*, 128*b* may be configured to outwardly deflect, bend, or deform so that when a product 118 that is to be dispensed is moving from the first interior section 114 and through inner channel 126, the product 118 may be able to expand the gap 130 between the prong(s) 128*a*, 128*b* or the prong 128 and an adjacent wall such that the gap 130 is at least as wide as the product 118 being dispensed. The prong(s) 128*a*, 128*b* may also be positioned to support product 118 in a dispensing position that provides the user access to at least a portion of the product 118 being dispensed, as illustrated by FIGS. 2 and 5. Further, the angled positioning and configuration of the prong(s) 128*a*, 128*b* may prevent product 118 in a dispensing position from reverting back into the first interior section 114 through the inner channel 126. Specifically, a downward force on the prong(s) 128*a*, 128*b*, such as when product 118 is attempting to be moved from the second interior region 116 to the first interior region 114 causes the gap 130 between the prong(s) 128*a*, 128*b* or prong 128 and wall to be reduced to a size that prevents such passage of the product 118.

According to certain embodiments, the inner channel 126 may be inwardly offset from the adjacent portion of the sidewall 102. Further, the distance that the inner channel 126 is offset from the sidewall 102 may be different across different portions of the second interior section 116. For example, as shown in FIG. 5, the front portion 132 of the inner channel 126 may be spaced further away from the adjacent portion of the sidewall 102 than a back portion 134 of the inner channel 126 is spaced away from its adjacent portion of the sidewall 102. According to certain embodiments, such spacing may be configured to provide an area for other components of the dispenser 100, such as the release mechanism 108.

The dispenser 100 also includes a lip seal arrangement to isolate at least a portion of the interior sections 114, 116 of the dispenser 100 from the exterior environment when the dispenser 100 is closed. According to the illustrated embodiment, the lip seal is provided by a closed lip 136 of the lid 104 engaging and/or abutting an upper region of the inner channel 126 when the lid 104 is in a closed position, as shown in FIG. 5. According to an embodiment, the lip 136 and/or upper region of the inner channel 126 may be configured to bend, deform, or deflect when the lip 136 engages the inner channel 126 so that the mating engagement of the lip 136 and inner channel 126 provide the desired seal. Such an engagement may also at least assist in maintaining the lid 104 in a closed position.

Figure 6:
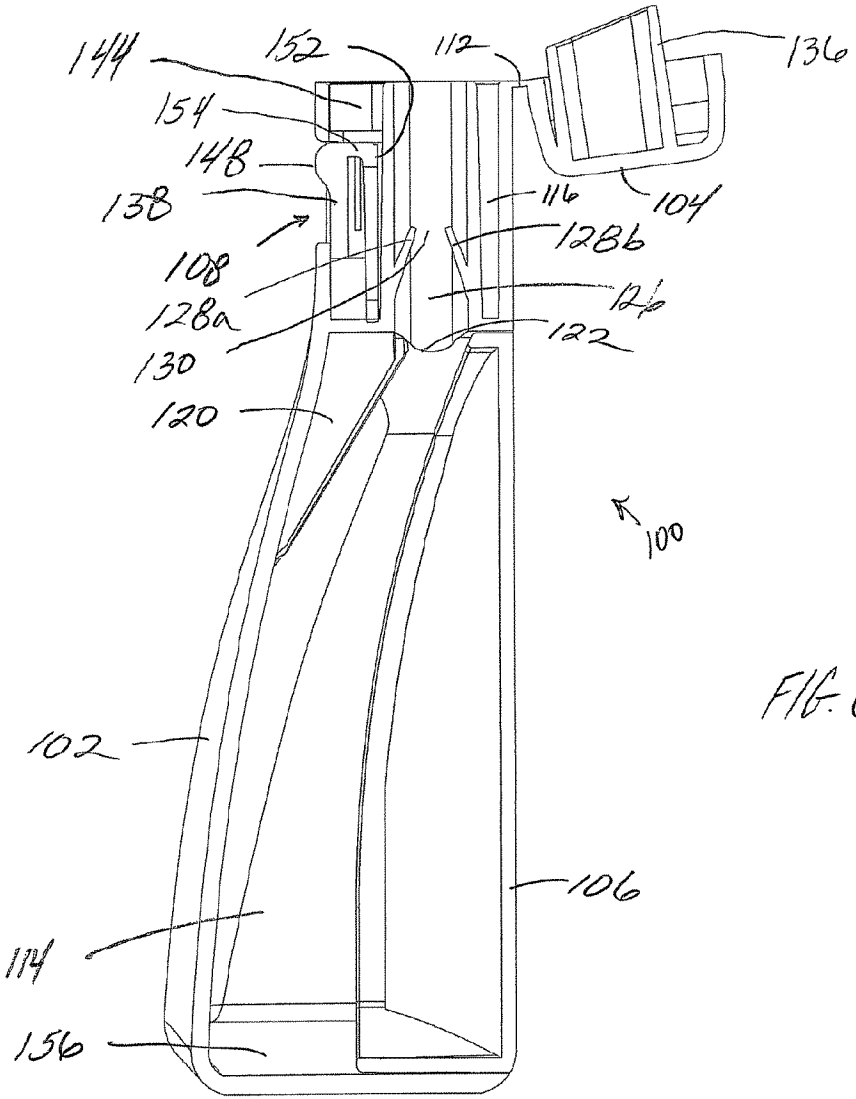
FIG. 6 illustrates a side cross sectional view of the dispenser shown in FIG. 2 without the dispensed product.
Figure 7:
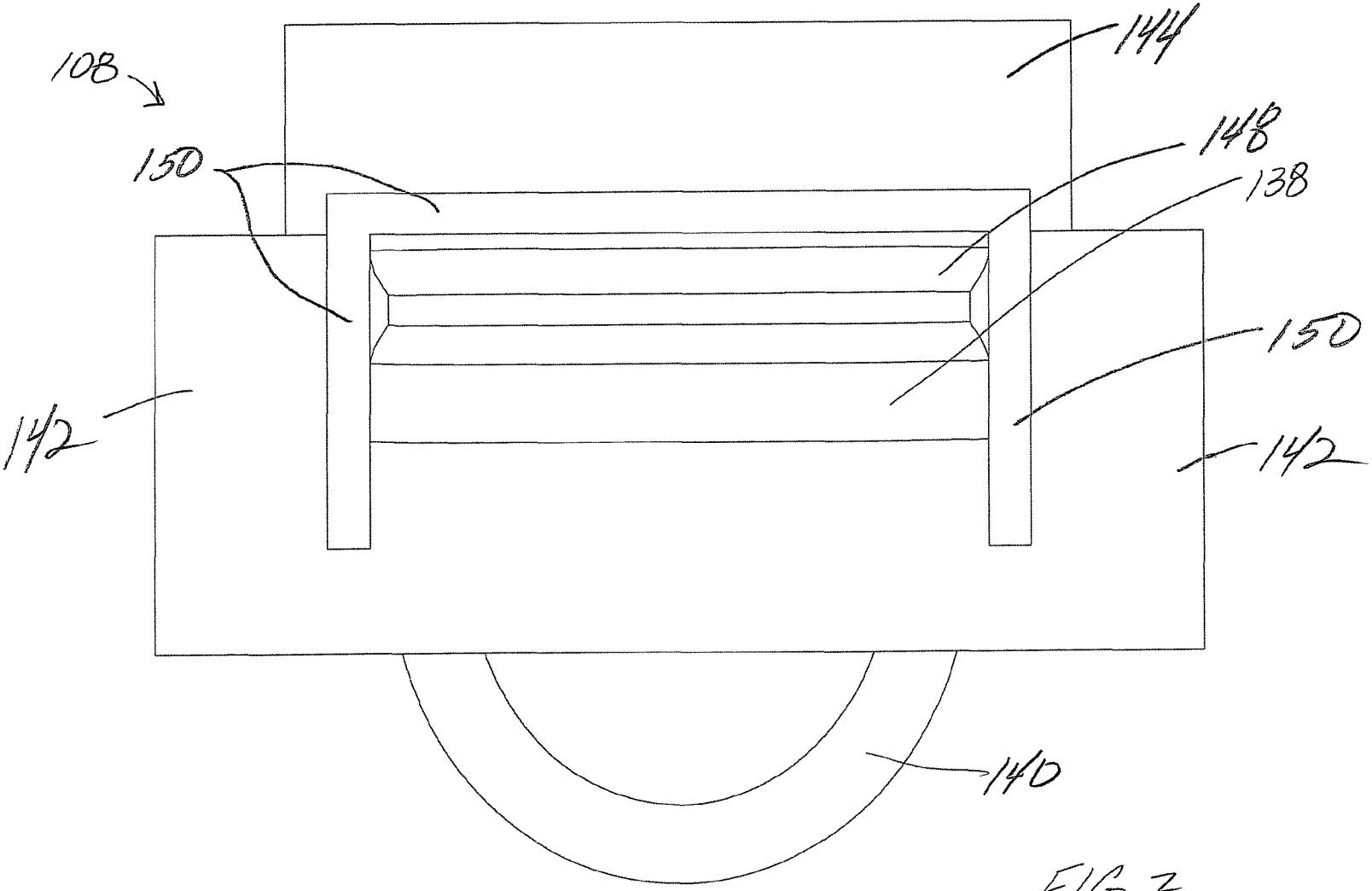
FIG. 7 illustrates a front view of a release mechanism according to an embodiment of the present invention.
Figure 8:
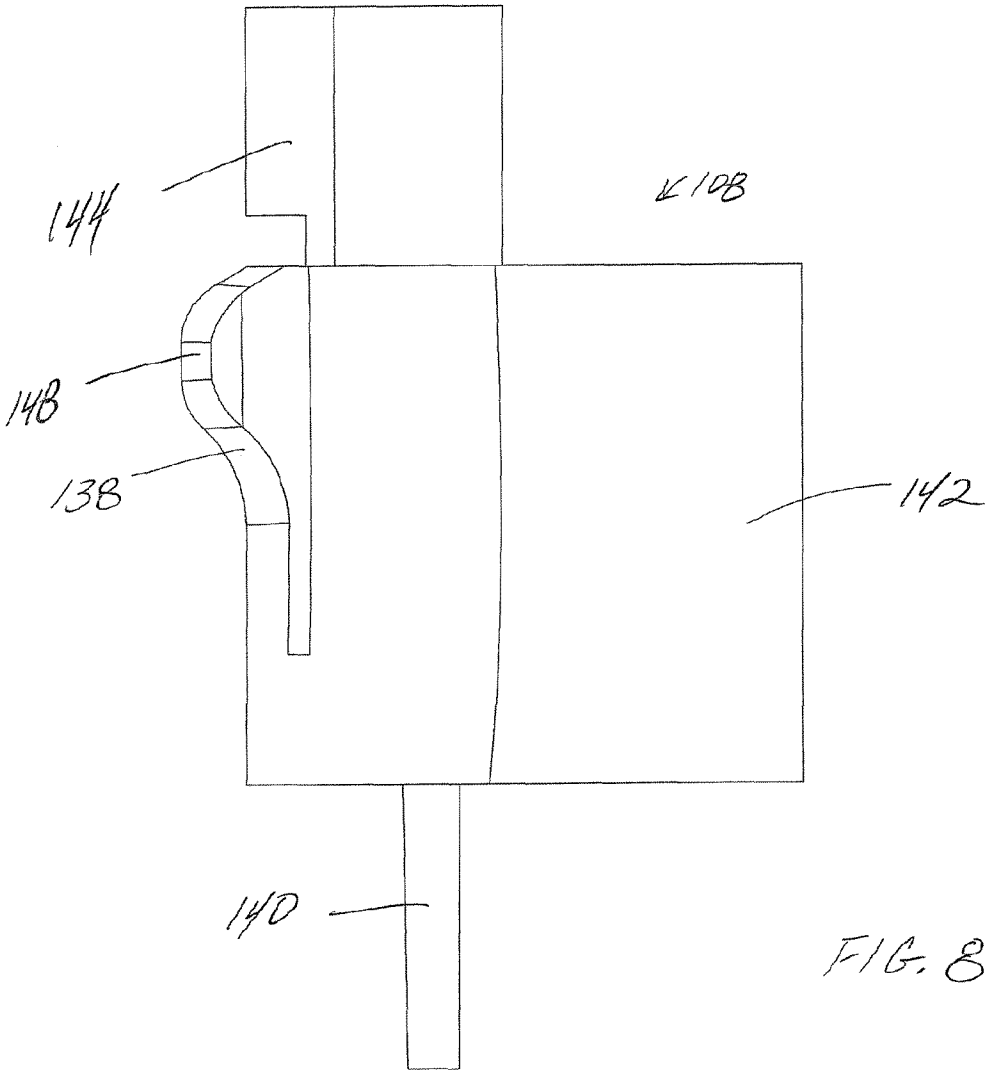
FIG. 8 illustrates a side view of the release mechanism shown in FIG. 7.
Figure 9:
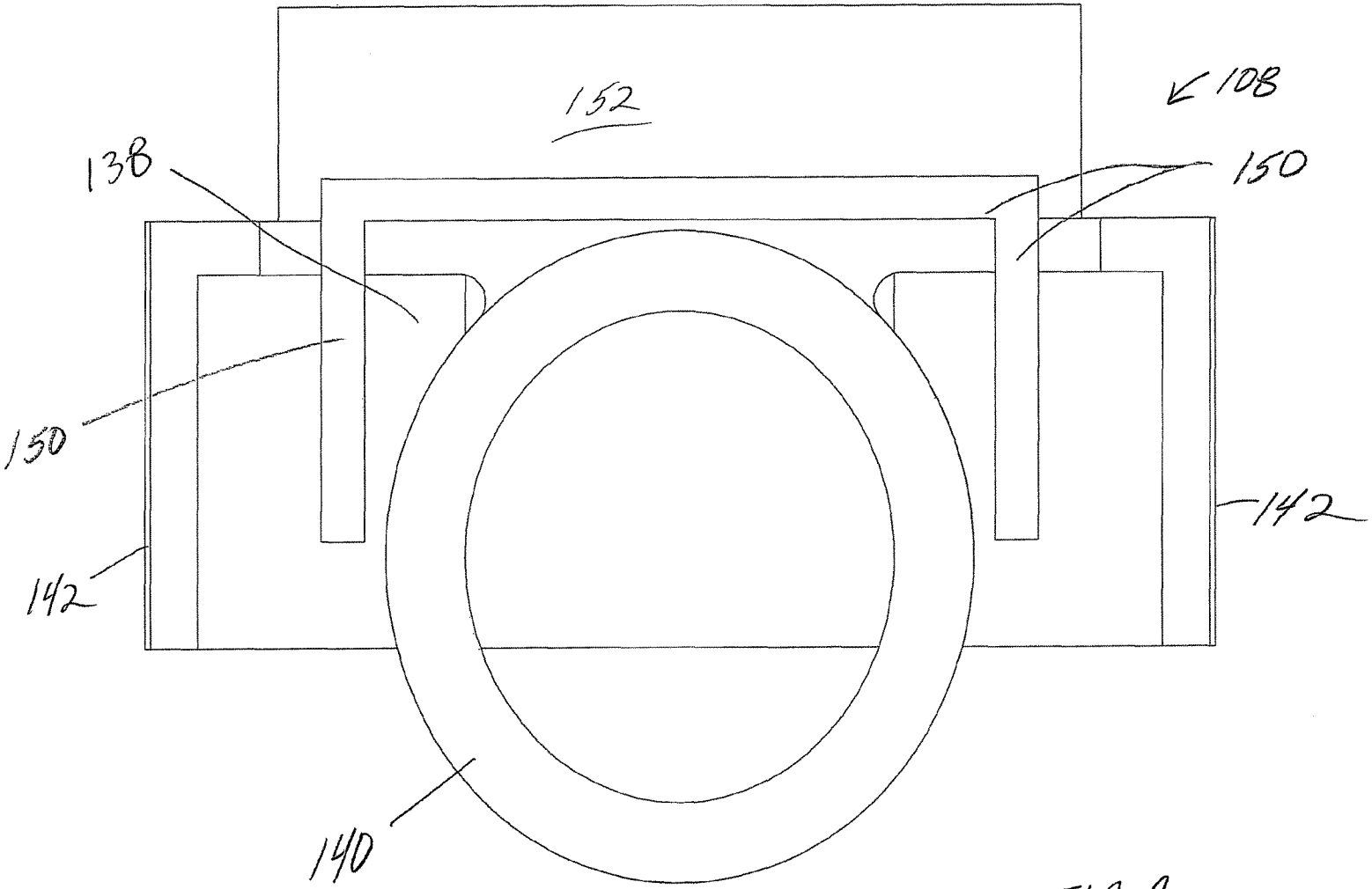
FIG. 9 illustrates a rear view of the release mechanism shown in FIG. 7.
Figure 10:
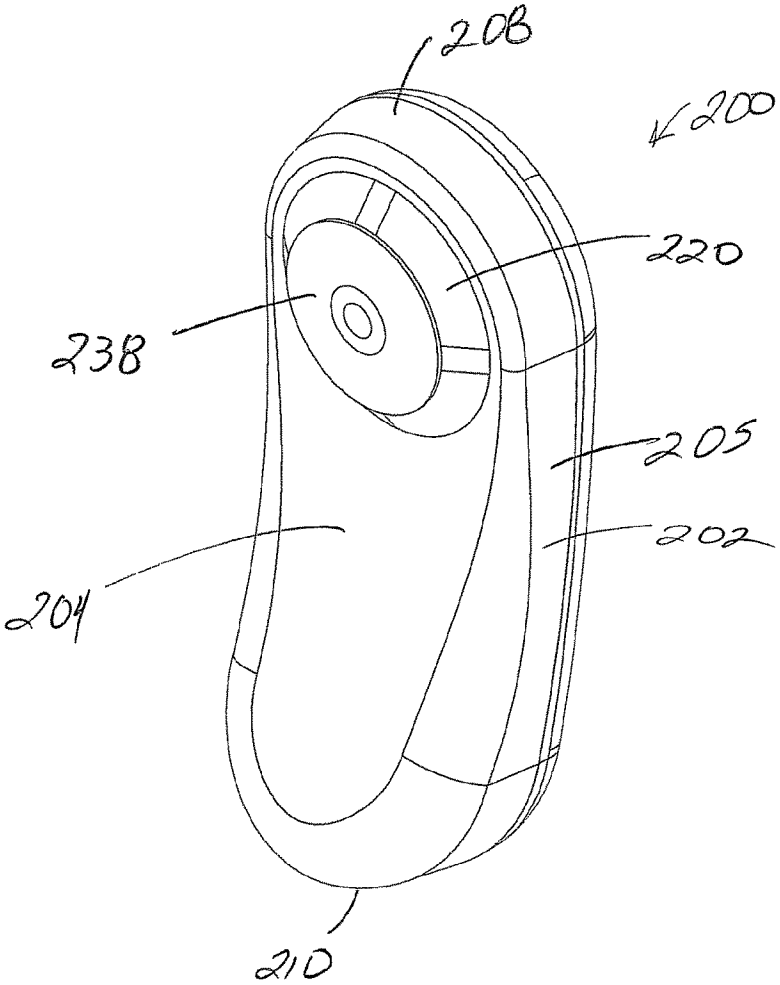
FIG. 10 illustrates a front perspective view of a dispenser with dispenser assembly in a closed position according to an embodiment of the present invention.
Figure 11:
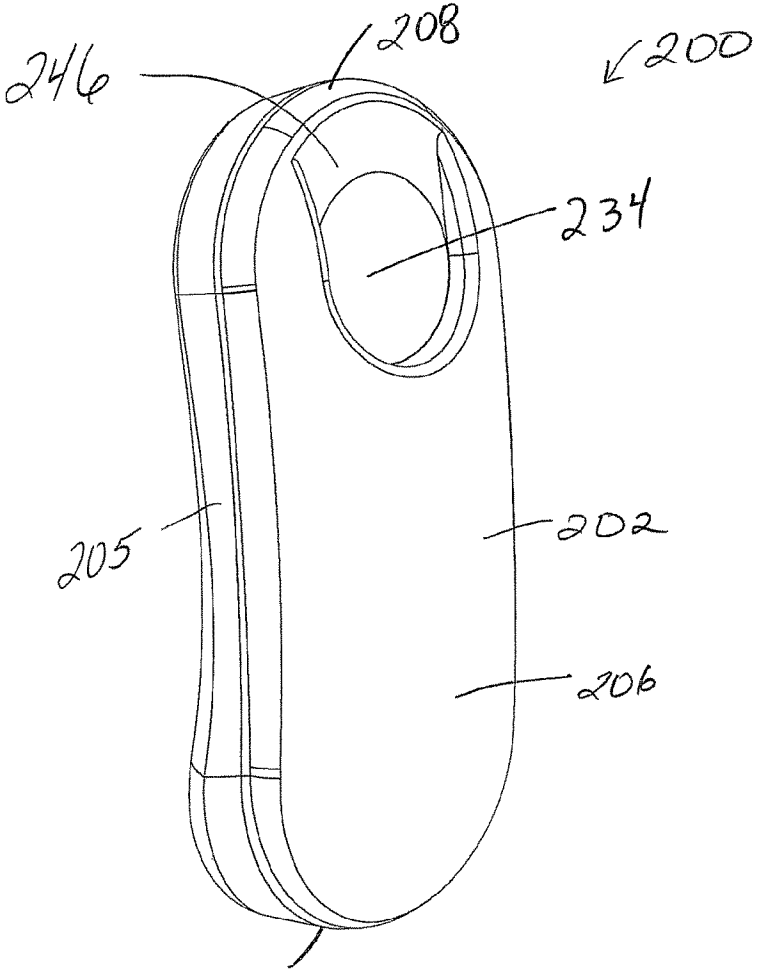
FIG. 11 illustrates a side perspective view of a dispenser with dispenser assembly in a closed position according to an embodiment of the present invention.
Figure 12:
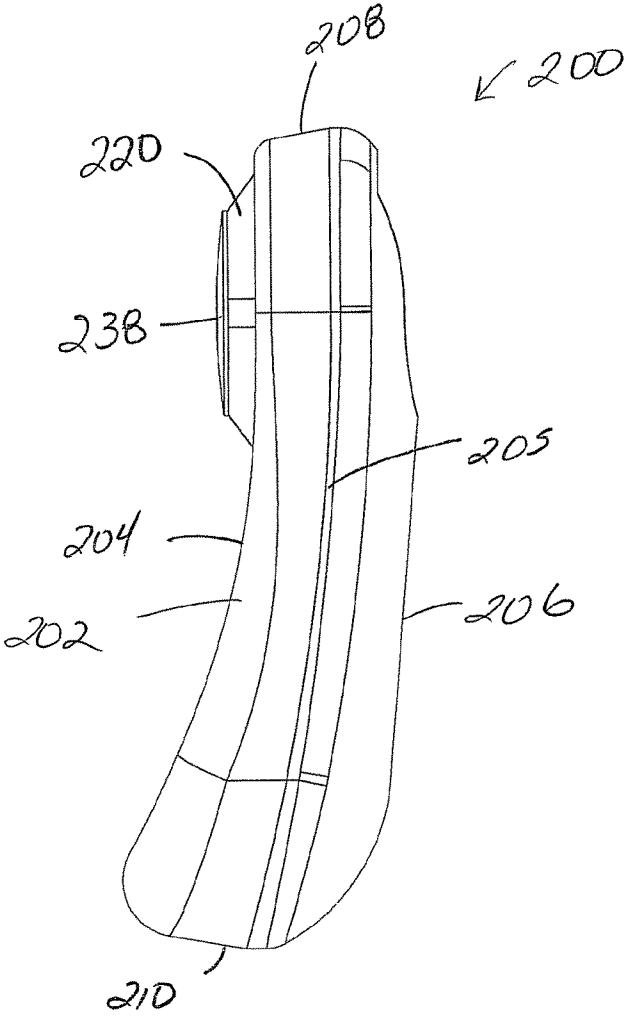
FIG. 12 illustrates a side view of the dispenser shown in FIG. 10.

FIGS. 7-9 illustrate the release mechanism 108 according to an embodiment of the present invention. The illustrated release mechanism 108 includes an activation portion 138, spring 140, sides 142, and an upper portion 144. As shown in FIGS. 5 and 6, at least a portion of the release mechanism 108 is positioned between the inner channel 126 and the sidewall 102 of the dispenser 100. As also shown, the activation portion 138 may be accessible to a user through an aperture in a sidewall 102 of the dispenser 100. According to the illustrated embodiment, the activation portion 138 includes an outwardly extending tab 148 that facilitates the ability of a user to engage the activation portion 138. The activation portion 138 may be separated from the sides 142 and upper portion 144 of the release mechanism 108 by slots 150. The sides 142 and upper portion 144 of the release mechanism 108 may extend along at least a portion of an interior region of the sidewall 102. As shown in FIG. 5, when the lid 104 is in a closed position, the release mechanism 108 is in a first position, in which opposing surfaces of the sides 142 and upper portion 144 of the release mechanism 108 may engage at least a portion of the sidewall 102 and the lip 136 of the lid 104. According to certain embodiments, such an engagement may assist in pressing on the adjacent portion of the lip 136 to at least assist in forming the desired seal with the inner channel 126. Additionally, such an engagement of the upper portion 144 and/or sides 142 of the release mechanism 108 may also assist in retaining the lid 104 in a closed position. Further, in view of such a configuration, according to certain embodiments, when the dispenser 100 is opened, there may be a space between the inner channel 126 and the upper portion 144 and sides 142 that is configured to receive the placement of at least a portion of the lip 136.

According to one embodiment, when the dispenser 100 is to be opened, the user may generally inwardly move the activation portion 138 so that a backside 150 of the activation portion 138 presses against an adjacent portion of the inner channel 126 to inwardly deflect or deform at least a portion or side of the inner channel 126 away from the adjacent portion of the lip 136. Further, such deformation of at least a portion of the inner channel 126 may release or decrease the force asserted against the portion of the lip 136 that is in contact with the upper portion 144 of the release mechanism 108, and thus reduce or eliminate the force the lip 136 is asserting against the upper portion 144. According to such an embodiment, the slots 150 around the activation portion 138 may allow or enhance a user's ability to inwardly bend or deform the activation portion 138. Further, a bridge 154 between the area of the tab 148 and the backside 150 of the activation portion 138 may act as a spring that is compressed or deformed when the user inwardly displaces the activation portion 138, and generally returns the activation portion 138 to its pre-pressed position when user releases the activation portion 138.

According to certain embodiments, as the inner channel 126 is being bent or deformed by the user generally inwardly pressing on the activation portion 138, the user may also be able to move or slide the activation portion 138 generally toward the base 156 of the dispenser 100 so as to lower the release mechanism 108, and more particularly the upper portion 144 of the release mechanism 108, in the dispenser 100 to a second position. According to such an embodiment, when in the second position, the upper portion 144 may be displaced so as to not interfere with the ability of the lip 136 to be moved between the closed and opened positions, and vice versa. When the user releases the activation portion 138, the spring 140 may bias the release mechanism 108 generally back to the first position.

When the lid 104 for an open dispenser 100 is to be closed, the user may again engage the release mechanism 108 in a manner similar to that used for opening a closed dispenser 100 by inwardly and downwardly manipulating the release mechanism 108 to the second position. When the lid 104 is in the closed position, the user may release the activation portion 138, thereby allowing the release mechanism 108 to return to the first position, where the upper portion 144 is pressed between at least a portion of both the sidewall 102 and the lip 136. However, as discussed above, according to certain embodiments, at least a portion of the upper portion 144 and the sides 142 of the release mechanism 108 may be separated from the inner channel 126 by a gap that is configured for receiving at least a portion of the lip 136. In such embodiments, the user may not necessarily need to inwardly press the activation portion 138 to deform a portion of the inner channel 126, but instead generally downwardly displace the activation portion 138 to the second position.

As illustrated in at least FIGS. 5 and 6, according to certain embodiments, the portion of the lip 136 adjacent to the upper portion 144 when the dispenser 100 is closed may extend further from the lid 104 than other portions of the lip 136 to allow for engagement of at least a portion of the lip 136 with the upper portion 144. Further, for embodiments in which the lid 104 is connected to the sidewall 102 by a hinge 112, portions of the lip 136 may be shorter than other portions of the lip 136 so as to minimize or prevent interference between the lip 136 and inner channel 126 when the lid 104 is being rotated to a closed position that may prevent the dispenser 100 from being closed.

FIGS. 10-18 illustrate a dispenser 200 according to an embodiment of the present invention. The dispenser 200 includes a dispenser body 202 having a front portion 204, sides 205, a back portion 206, a top portion 208, and a bottom portion 210. At least a portion of the dispenser body 202 defines an interior region 211 that is configured to house or contain product(s) 118. The dispenser body 202 may have a variety of different shapes and sizes, including, for example, rectangular, cylindrical, circular, or oval, among others. Further, the dispenser body 202 may be contoured, as shown in FIGS. 10-18 for example, to improve the ergonomic configuration of the dispenser 200, to assist in directing the movement or orientation of product 118 contained in the interior region 211 when product 118 is to be dispensed from the dispenser 200, and/or to limit the amount of product 118 that may be dispensed each time the dispenser 200 is opened.

The dispenser 200 also includes a cap assembly 212 and a piston assembly 214 that are configured to assist in the dispensing of product(s) 118 contained in the interior region 211 from the dispenser 200. According to the illustrated embodiment, the piston assembly 214 includes a front outer portion 216 that is positioned about an aperture 218 in the front portion 204 of the dispenser body 202. The front outer portion 216 may have a generally circular or cylindrical shape, among others. A spring portion 220 of the piston assembly 214 outwardly extends from the front outer portion 216 and terminates at a piston opening 222. The spring portion 220 is configured to bias the piston assembly 214 and cap assembly 212 in the closed position, as shown by at least FIG. 10. Further, as shown by at least in FIGS. 12 and 13, when the piston assembly 214 is in the closed position, the spring portion 220 may be angled or tapered toward the piston opening 222. A piston hub 224 may extend from the spring portion 220 and into the interior region 211 of the dispenser body 202. According to certain embodiments, the interior of the piston hub 224 may further define the piston opening 222. At least one prong 228 extends from the piston hub 224. According to the illustrated embodiment, the piston assembly 214 includes two prongs **228*a*, 228*b* that are spaced apart to form first and second openings 230, 232. The prongs 228*a*, 228*b* terminate in a cover 234. The cover 234 is configured to be positioned about an orifice 236 in the back portion 206 of the dispenser body 202 when the piston assembly 214** is in a closed position.

According to the illustrated embodiment, the cap assembly 212 includes a cap 238, an outer hub 240, and an inner hub 242. The cap 238 is configured to cover the piston opening 222. The outer hub 240 extends from the cap 238 and is configured for placement in or along the interior of the piston hub 224. Moreover, the cap 238 and piston assembly 214 may be operably connected, such as for example, by a press or interference fit, adhesives, plastic welding, or mechanical fasteners, among others. Alternatively, according to certain embodiments, the cap assembly 212 and piston assembly 214 may be integrally molded together as a single component. According to the illustrated embodiment, the inner hub 242 also extends from the cap 238. However, according to other embodiments, the inner hub 242 may extend from the outer hub 240, or be an extension, such as a prong or arm, of the outer hub 240. Further, the outer and inner hubs 240, 242 may have a variety of shapes and configurations, including cylindrical, oval, non-circular, square, triangular, or rectangular, among others.

Figure 13:
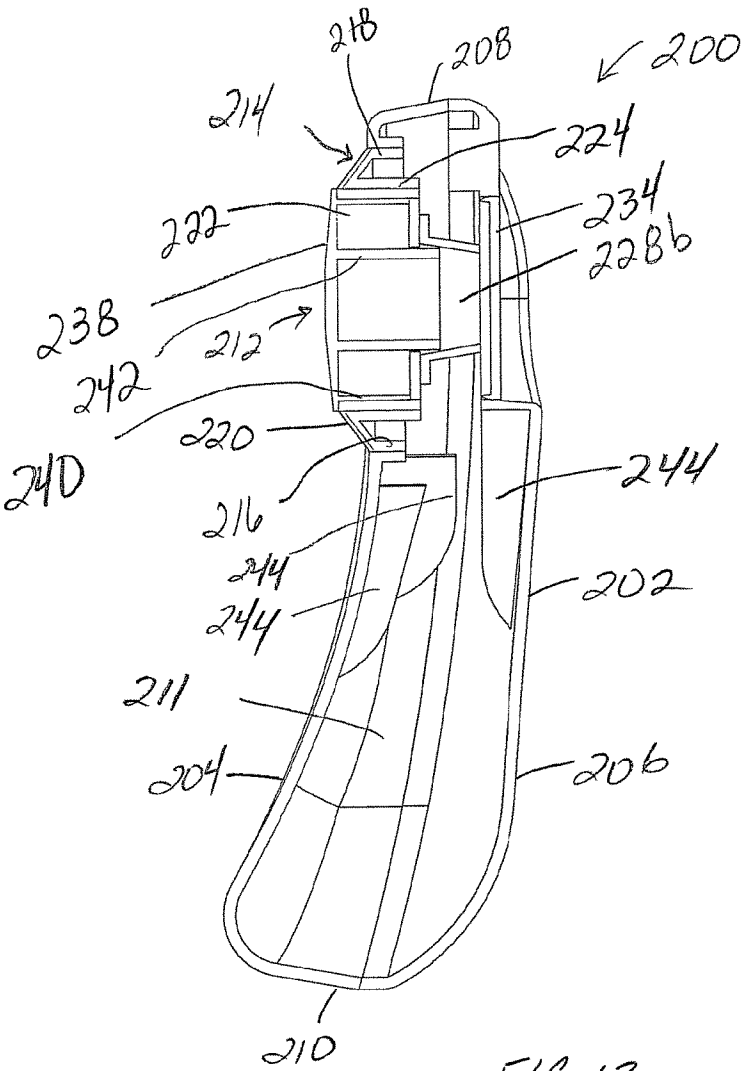
FIG. 13 illustrates a side cross sectional view of the dispenser illustrated in FIG. 10.
Figure 14:
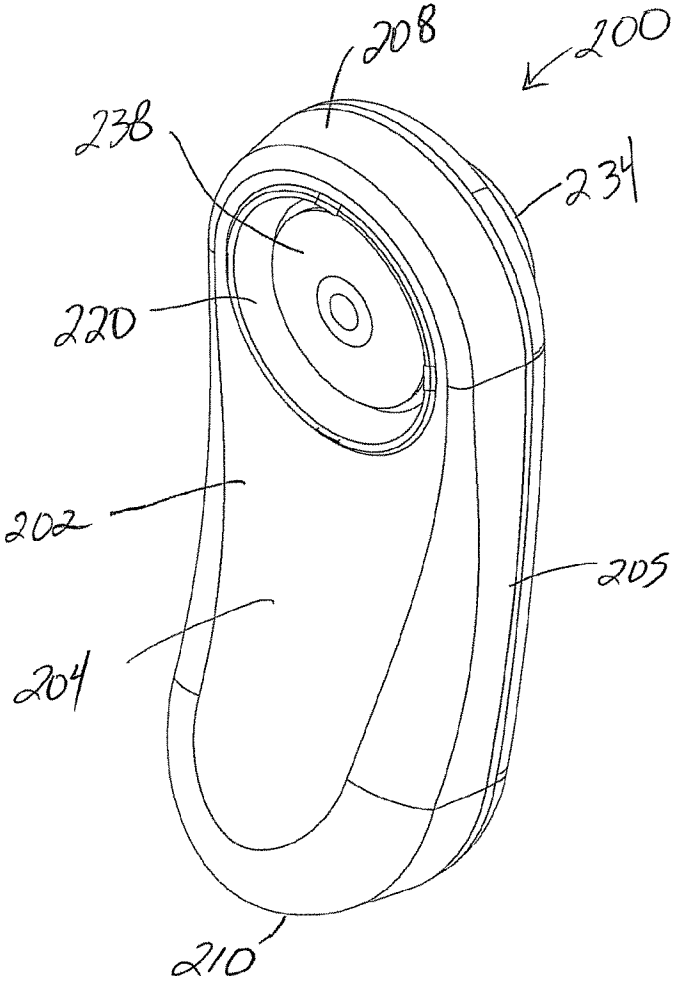
FIG. 14 illustrates a front perspective view of the dispenser illustrated in FIG. 10 with dispenser assembly in an opened position.
Figure 15:
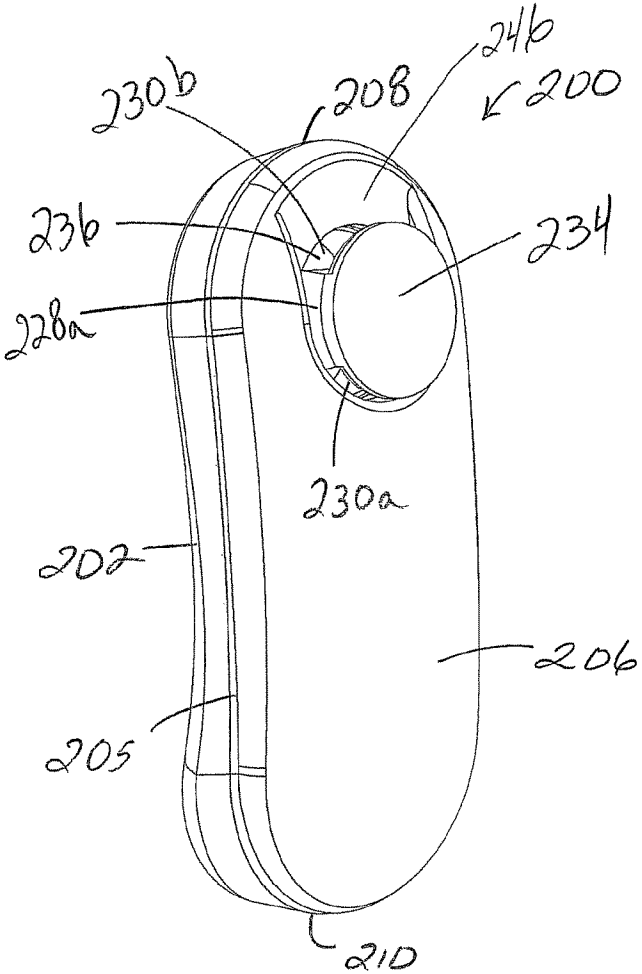
FIG. 15 illustrates a rear perspective view of the dispenser illustrated in FIG. 10 with dispenser assembly in an opened position.
Figure 16:
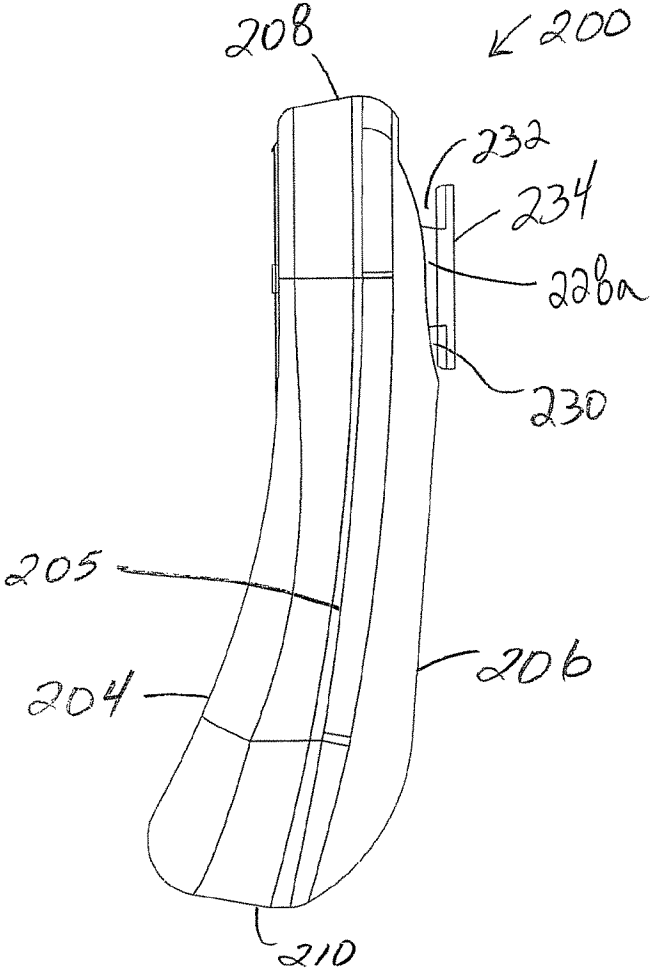
FIG. 16 illustrates a side view of the dispenser shown in FIG. 10 with dispenser assembly in an opened position.
Figure 17:
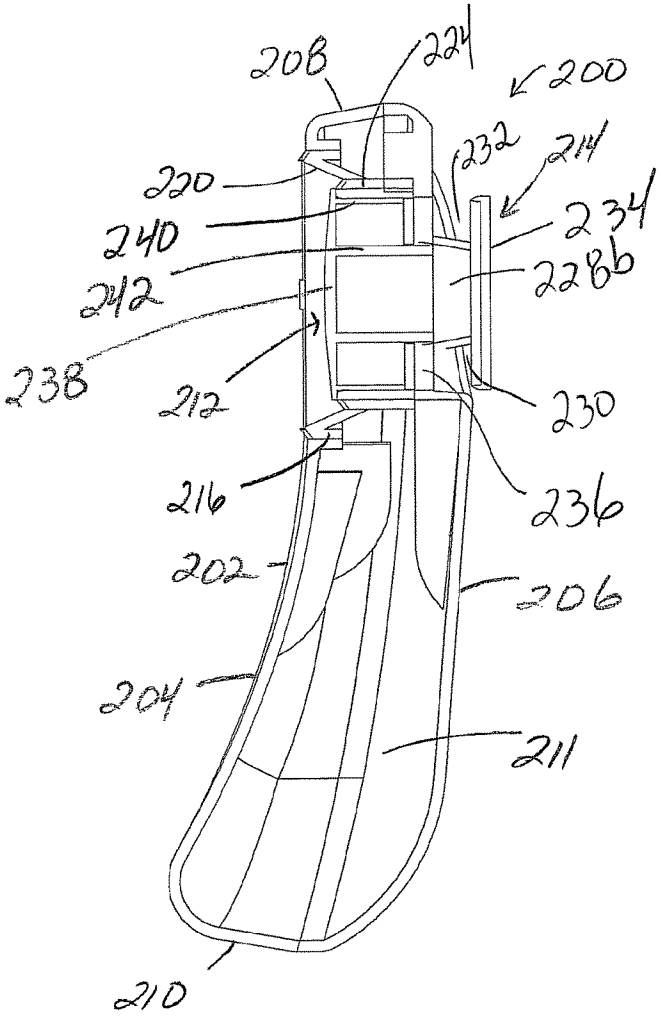
FIG. 17 illustrates a side cross sectional view of the dispenser shown in FIG. 10 with dispenser assembly in an opened position.
Figure 18:
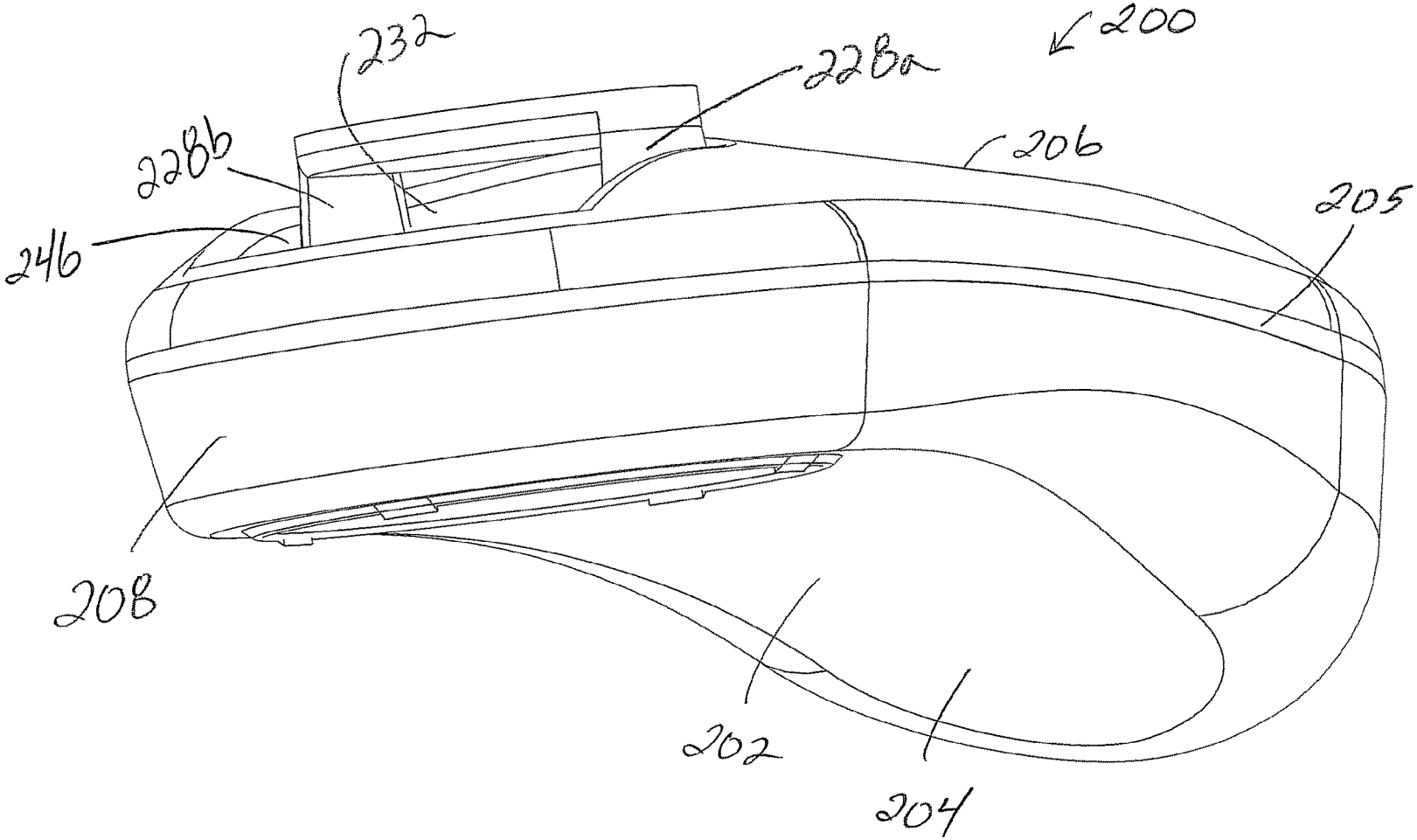
FIG. 18 illustrates a perspective view of the dispenser shown in FIG. 10 with dispenser assembly in an opened position.

When product 118 is to be dispensed and the dispenser 200 is in a closed position, the dispenser 200 may be turned, twisted, or otherwise positioned so that product 118 in the interior region 211 moves toward or is positioned at the cap/piston assemblies 212, 214 portion of the dispenser 200. According to certain embodiments, the body portion 202 may include guides 244, such as at least one fin, that may assist in guiding the movement and/or positioning of the product 118 in the interior region 211 of the dispenser 200. As shown in FIG. 13, guides 244 may extend from both the front portion 212 and back portion 214 sides of the interior region 111. The guides 244 may at least assist with orienting product 118 that is to be dispensed so that the product 118 is properly positioned to pass through the first opening 230 between the prongs 228*a*, 228*b* and/or fit in the space between the cover 234 of the piston assembly 214 and the inner hub 242 of the cap assembly 212. Additionally, the guides 244 may or may not also be configured to provide structural support to the dispenser body 202. Alternatively rather than use guides 244, the dispenser body 202 may be configured, such as providing a narrowed or necked region that assist in properly orienting product 118 that is to be dispensed so that the product 118 may pass through the first opening 230. Additionally, or alternatively, according to other embodiments, the user may manipulate the positioning or movement of the dispenser 200 so that the orientation of product 118 in the interior region 211 that is dispensed is moved relative to the dispenser 200 until the product 118 and/or dispenser is oriented so that the product 118 may pass through the first opening 230.

Product 118 positioned between the inner hub 242 of the piston assembly 214 and the cover 234 of the cap assembly 212 may be dispensed from the dispenser 200 by the user inwardly pressing on the cap 238 until the dispenser 100 reaches an opened position, as shown in FIGS. 15-18. More specifically, as the user presses the cap 238, the cap 238 moves towards the back portion 206 of the dispenser body 202. This inward movement of the cap 238 also causes the spring portion 220 of the piston assembly 214 to be inwardly bent, deform, deflect, or compressed from its first position to a second position such that the piston hub 224 also moves toward the back portion 206 of the dispenser body 202. This movement of the piston hub 224 also causes the prongs 228*a*, 228*b* to be moved such that the cover 234 is displaced from the dispenser body 202. Product 118 contained between the inner hub 242 and the cover 234 may also be moved with the movement of the cap and piston assemblies 212, 214 by at least the inner hub 242 outwardly pressing on the product 118. The cap assembly 212 and piston assembly 214 may continue to be displaced until at least the space between the cover 238 and the dispenser body 202 adjacent to the second opening 232 is sufficient for the product 118 to pass through the second opening 232 and be dispensed to the user. Further, according to certain embodiments, to ensure that product 118 is dispensed to the user through the second opening 232 rather than the first opening 230, the back portion 206 of the dispenser body 202 may include a recess 246 about the back portion 206 that is adjacent to the second opening 232. The recess 246 may be configured to provide a channel through which product 118 may pass through the second opening 232 and be dispensed to the user, while the back portion 206 of the dispenser body 202 adjacent to the first opening 230 is raised or otherwise oriented so as to prevent the dispensing of product 118 to the user through the first opening 230.

To return the dispenser 200 from the opened position to the closed position, the user may release the cap 238. The spring portion 220 of the piston assembly 214 may then return to its first position, where the spring portion 220 again biases the cap and piston assemblies 212, 214 in a closed position. More specifically, as the spring portion 220 returns to its first position, it causes the cap 238, inner hub 242, piston hub 224, prongs 228*a*, 228*b*, and cover 234 to also return to their positions for the dispenser to be in the closed position. Moreover, the cover 234 returns to its position of closing or covering the orifice 236 in the back portion 206 of the dispenser 200.

FIGS. 19-25 illustrate a dispenser 300 according to an embodiment of the present invention. The dispenser 300 includes a dispenser body 302 and a dispenser wheel 304. The dispenser body 302 has a sidewall 306 and a bottom portion that generally defines an interior region 310 that is configured to house product(s) 118. The sidewall 306 terminates at an opening 312 that is configured to receive at least a portion of the rotatable dispenser wheel 304. The sidewall 306 may take a variety of different shapes and configurations, including being generally rectangular, square, cylindrical, circular, and non-circular, among others. As shown at least in FIG. 19, the sidewall 306 may be contoured, so as to increase the capacity of the dispenser 300 to house product 118, assist in limiting the quantity or rate of product 118 that may reach or be present at the opening 312 end of the dispenser body 302 at a given time, and/or to improve the ergonomics of the dispenser 300.

The dispenser wheel 304 is configured to rotate about the opening 312 and to receive and dispense product 118 that is housed in the dispenser 300. The dispenser wheel 304 includes an outer wall 314 and sidewalls 316*a*, 316*b* that generally define an inner portion 318. The inner portion 318 is configured to receive at least a portion of product 118 that is to be dispensed from the dispenser 300. Moreover, the outer wall 314 has a gap 320 that is sized to allow at least a portion of the product 118 to be received or placed within the inner portion 318 of the dispenser wheel 304. According to certain embodiments, a pin or post 322 may extend from each sidewall 316*a*, 316*b* of the dispenser wheel 304. The post(s) 322 may mate with orifices 324 in the sidewall 306 of the dispenser body 302. According to such an embodiment, the post(s) 322 may rotate inside the mating orifices 324 such that the dispenser wheel 304 may be rotated from a closed position to an opened position, and vice versa. Alternatively, according to other embodiments, the post(s) 322 may extend from opposing interior surfaces of the sidewall 306 of the dispenser body 302. According to such an embodiment, the sidewalls 316*a*, 316*b* of the dispenser wheel 304 may have apertures through which a post(s) may be inserted. According to such an embodiment, the dispenser wheel 304 may be rotated about the post(s). According to other embodiments, the sidewall 306 of the dispenser body 302 includes one or more orifices 324 that are position to align with one or more apertures in the sidewalls 316*a*, 316*b* of the dispenser wheel 304. According to such embodiments, the orifice(s) 324 and aperture(s) are configured to receive a post(s) about which the dispenser wheel 304 may rotate or which the dispenser wheel 304 and post(s) may be rotated.

Figure 19:
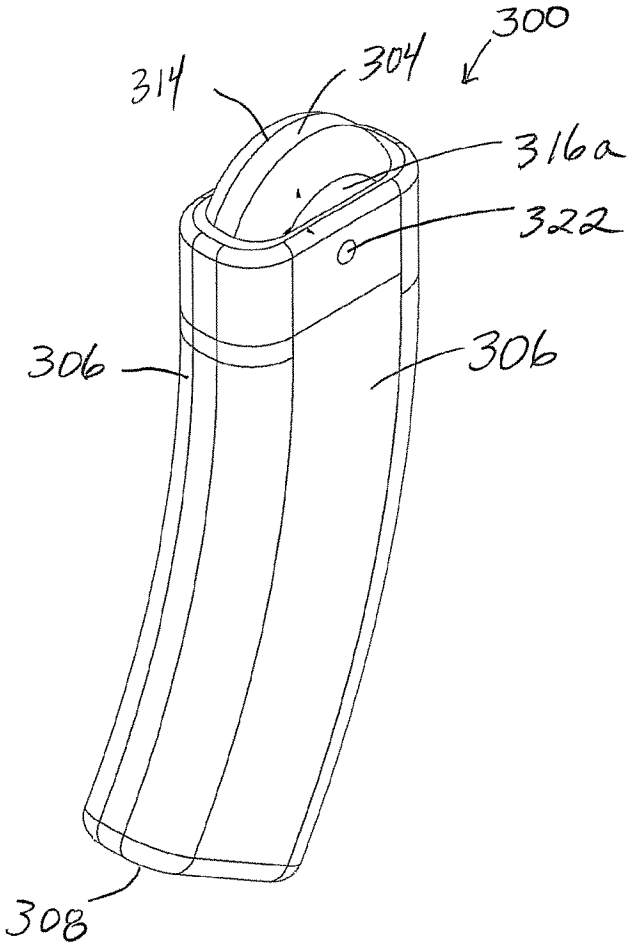
FIG. 19 is a perspective view of a dispenser in a closed position according to an embodiment of the present invention.
Figure 20:
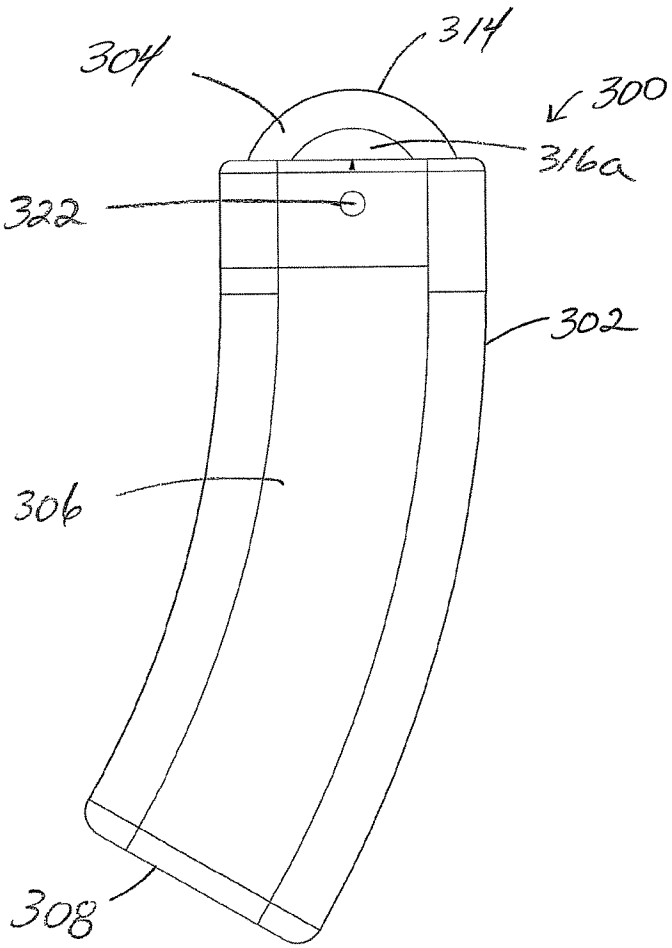
FIG. 20 is a first side view of the dispenser illustrated in FIG. 19.
Figure 21:
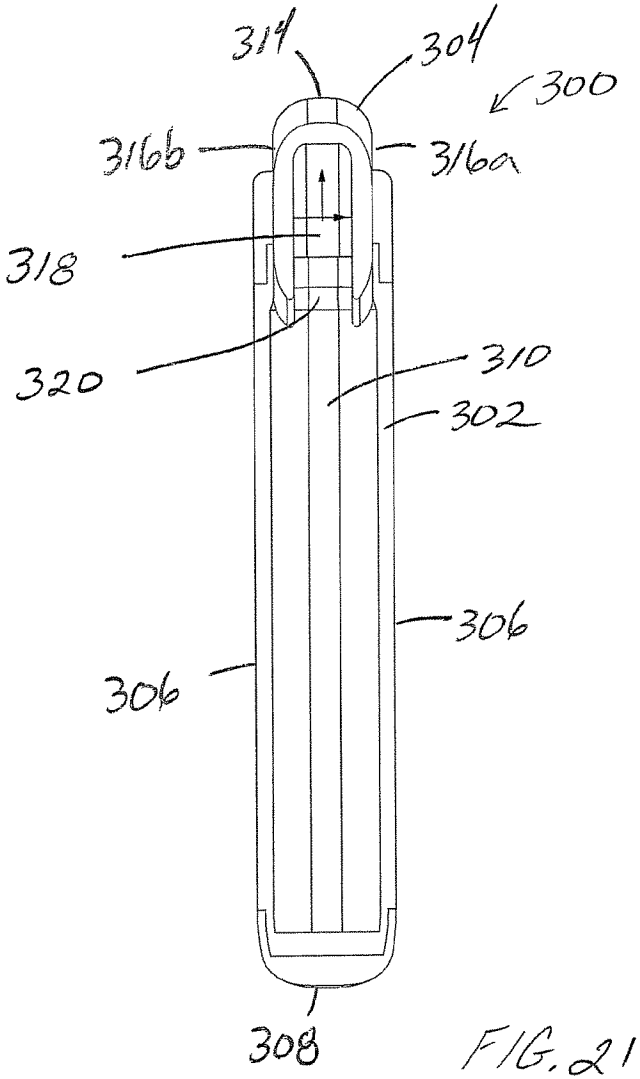
FIG. 21 is a second side cross sectional view of the dispenser illustrated in FIG. 19.
Figure 22:
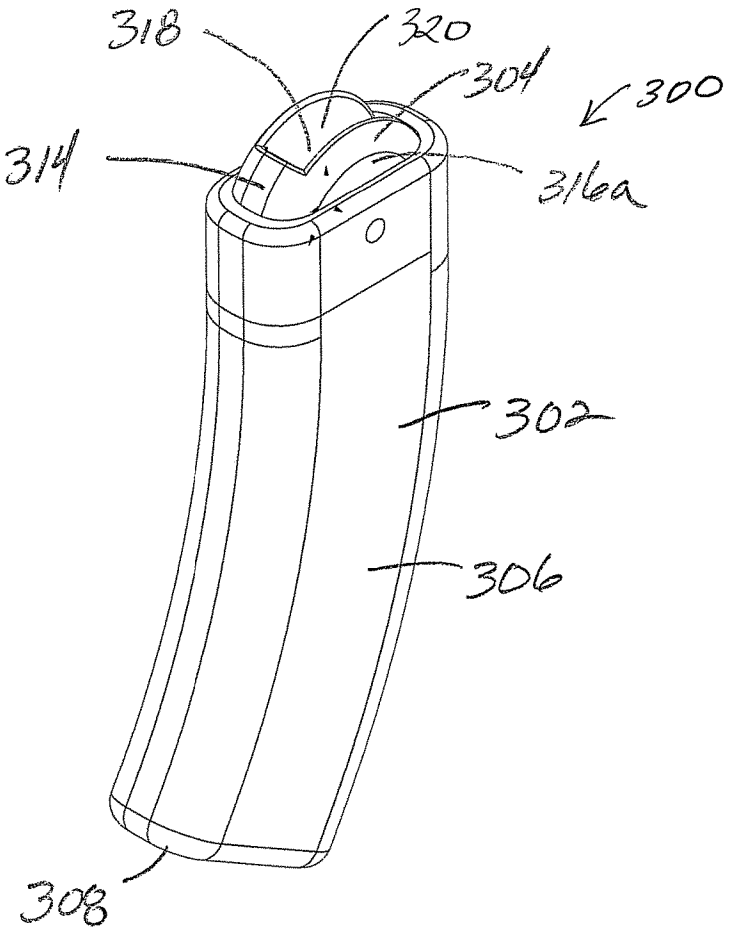
FIG. 22 is a perspective view of a dispenser in an opened position according to an embodiment of the present invention.
Figure 23:
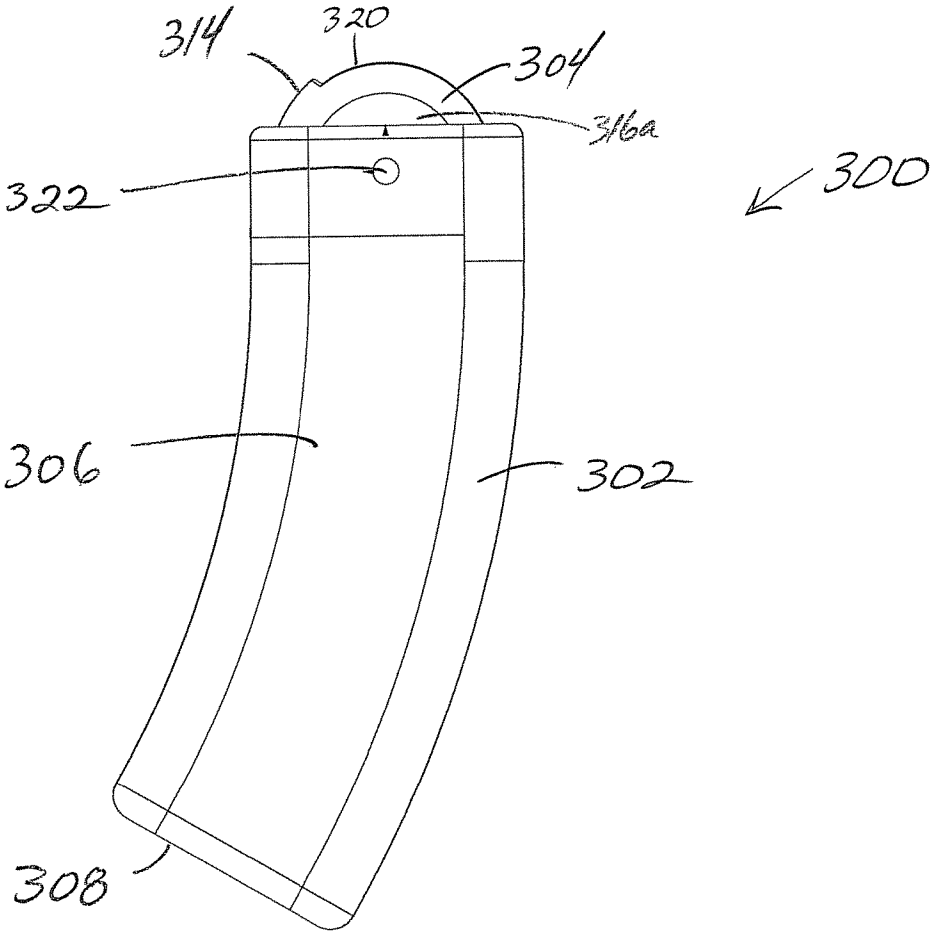
FIG. 23 is a first side view of the dispenser illustrated in FIG. 22.
Figure 24:
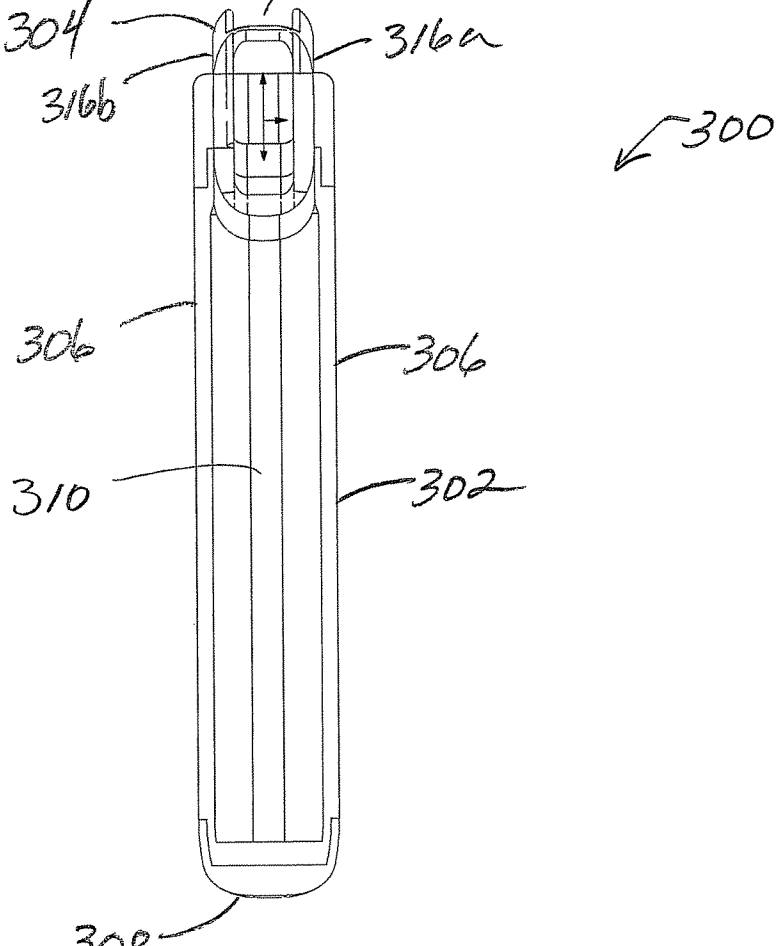
FIG. 24 is a second side view of the dispenser illustrated in FIG. 22.
Figure 25:
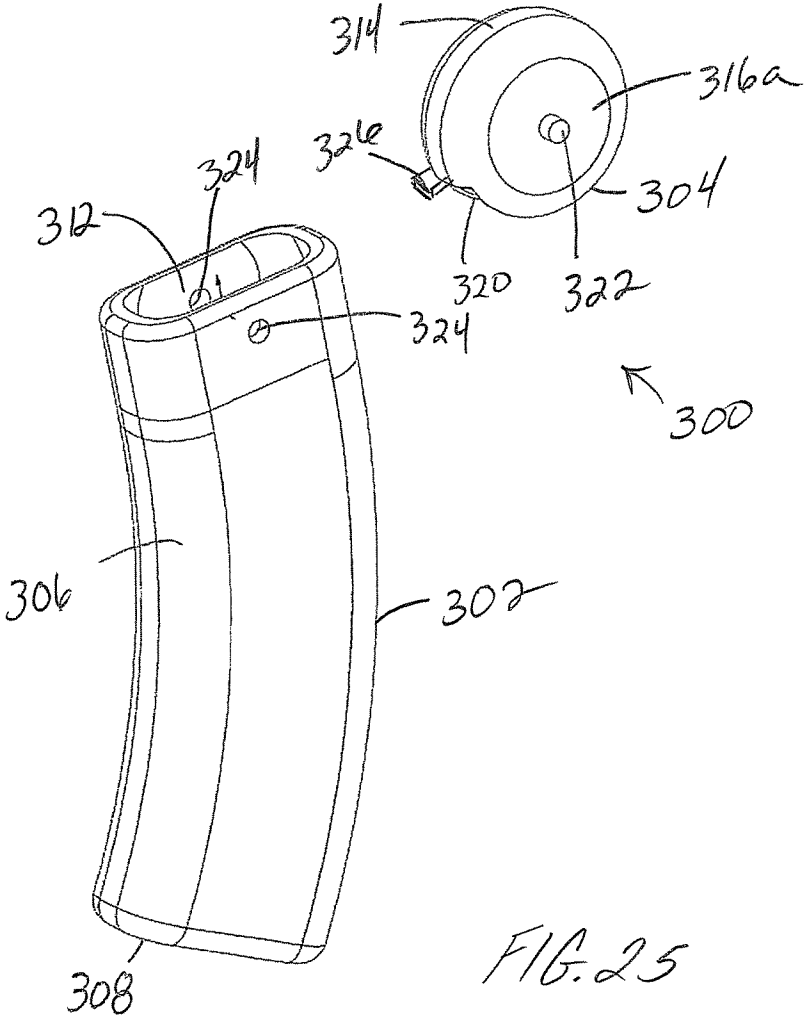
FIG. 25 is an exploded view of the dispenser illustrated in FIG. 19 and including an optional tab extending from the dispenser wheel.

The dispenser wheel 304 may optionally include a tab 326 that extends from the dispenser wheel 304, such as from the outer wall 314, and is configured to limit the rotational movement of the dispenser wheel 304. For example, when the dispenser 300 is in a closed position, as shown in FIG. 19, the tab 326 may extend outwardly from the dispenser wheel 304 such that the tab 326 engages or is in proximity to an interior portion of the sidewall 306 of the dispenser body 302. As the dispenser wheel 304 is rotated to an opened position, the tab 326 moves with the dispenser wheel 304 until the tab 326 engages the interior portion of a sidewall 306 that is opposite the sidewall 306 that was engaged or in proximity to the tab 326 when the dispenser wheel 304 was in a closed position.

During dispensing, when the dispenser 300 is in a closed position, the dispenser 300 may be manipulated, such as turned or twisted, for example, so that product 118 in the interior region 310 of the dispenser body 302 passes through the gap 320 of the dispenser wheel 304 and into the inner portion 318 of the dispenser wheel 304. The user may then rotate the dispenser wheel 304 to the opened position. Once in the open position, the product 118 may be dispensed to the user from the dispenser wheel 304 through the gap 320.

The dispenser wheel 304 maybe sized and shaped to fit snugly within opening 312 so as to create a seal when the dispenser 300 is in the closed position. The dispenser wheel 312 and/or a portion of the dispenser body 302 about the opening 312 may be formed of a material suitable for forming such a seal, such as an elastomeric material. In another embodiment, a gasket could be provided between the dispenser wheel 304 and the opening 312.

What is claimed is:

1. A dispenser for the dispensing of product comprising:

a dispenser body having a sidewall, the sidewall generally defines a first interior section and a second interior section, the first interior section configured to house the product, the second interior section configured for the dispensing of the product, the second interior section having an inner channel and an opening, the opening configured to allow product to move from the first interior section into the inner channel, the inner channel having at least one prong that is configured to prevent product to be dispensed from the inner channel from reverting back to the first interior section;

a lid having a lip configured to engage the inner channel when the dispenser is in a closed position to form a seal about an upper portion of the inner channel that prevents ambient air from passing through the seal and into the inner channel; and a release mechanism having an activation portion, an upper portion, at least a portion of the activation portion positioned about an aperture in the sidewall, the upper portion being positioned in the second interior portion between the sidewall and the lip when the lid is in a closed position, wherein the activation portion includes a backside and bridge, the bridge configured to bias the activation portion about the aperture in the sidewall, wherein when the dispenser is in a closed position the backside engages an adjacent portion of the inner channel when the activation portion is inwardly depressed so as to bend or deflect the adjacent portion of the inner channel away from at least a portion of the lip.

2. The dispenser of claim 1 wherein the release mechanism includes a spring, the spring configured to bias the release mechanism in a first position in which the upper portion engages the interior portion of the sidewall and lip.

3. The dispenser of claim 1, wherein the release mechanism includes a slot between at least a portion of the activation portion and the upper portion.

4. The dispenser of claim 1, wherein the release mechanism includes sides that are separated from at least a portion the activation portion by one or more slots.

5. The dispenser of claim 1, wherein the activation portion includes a tab.

6. The dispenser of claim 1, wherein the inner channel includes two prongs, the two prongs extending from the inner channel away from the first inner section.

7. The dispenser of claim 1, wherein the lid is attached to the dispenser body by a hinge.

8. The dispenser of claim 1, further including a cap that is operably attached to the dispenser body, the cap herein the dispenser body includes an opening that is covered by a cap, the opening providing access to the first interior section.

9. The dispenser of claim 8, wherein the cap may be repeatedly removed from the dispenser opening to permit the re-insertion of product into the first interior section.

10. The dispenser of claim 1 further including at least one guide positioned in the first interior section, the at least one guide configured to properly orient product to be dispensed so that the product may enter into the opening of the second interior section.

11. The dispenser of claim 1 further including at least one guide positioned in the second interior section, the at least one guide configured to properly orient product to be dispensed so that the product may enter into the inner channel of the second interior section.

* * * * *